US006920667B2

(12) United States Patent
Joesten

(10) Patent No.: US 6,920,667 B2
(45) Date of Patent: Jul. 26, 2005

(54) HANDLE EXTENDER

(76) Inventor: Charles David Joesten, 1276 N. Wayne St., #1208, Arlington, VA (US) 22201

( * ) Notice: Subject to any disclaimer, the term of this patent is extended or adjusted under 35 U.S.C. 154(b) by 1 day.

(21) Appl. No.: 10/676,492

(22) Filed: Oct. 2, 2003

(65) Prior Publication Data

US 2005/0071951 A1 Apr. 7, 2005

(51) Int. Cl.[7] ..... A47B 95/02

(52) U.S. Cl. ..... 16/114.1; 16/406; 190/116; 294/137

(58) Field of Search ..... 16/114.1, 406, 16/436, DIG. 12, 422, 421, 431; 190/115, 116, 18 A; 294/137, 171, 156, 165, 154, 167; 383/6, 13

(56) References Cited

U.S. PATENT DOCUMENTS 187,716 A * 2/1877 Kirk
4,982,885 A * 1/1991 Severson et al. ..... 224/675
5,319,829 A * 6/1994 Manuel
5,353,900 A * 10/1994 Stilley
D368,372 S * 4/1996 Dennison ..... D3/327
5,722,118 A * 3/1998 Hansen et al.
5,867,868 A * 2/1999 Ward
5,878,853 A * 3/1999 DeRouen et al.
5,898,975 A * 5/1999 Hancock
6,360,402 B1 * 3/2002 Grabtree
6,578,231 B1 * 6/2003 Godshaw et al.
6,708,375 B1 * 3/2004 Johnson ..... 24/17 A
6,711,784 B2 * 3/2004 Walker
6,722,689 B2 * 4/2004 Kreamer

* cited by examiner

*Primary Examiner*—Suzanne Dino Barrett
*Assistant Examiner*—Mark Williams

(57) ABSTRACT

This invention is directed to assist users of hand-carried, wheeled luggage in maintaining extraordinary lateral and obstruction-free use of the wheeled object without the problems associated with conventional wheeled luggage handle assemblies. The intent of the attachment device is to create enough lateral clearance between the user's body, legs, and feet and the luggage piece or handle framework to provide this obstruction-free use.

10 Claims, 6 Drawing Sheets

HANDLE EXTENDER

CROSS-REFERENCE TO RELATED PATENTS

U.S. Pat. No. 6,578,231

U.S. Pat. No. 6,301,746

U.S. Pat. No. 5,722,118

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The field of endeavor for this invention is in the class of a handle for wheeled objects, such as hand-carried luggage or wheeled carts. The recommended U.S. Patent classification for Miscellaneous Hardware is 16, the sub-classification for Handle, Handle Component, or Handle Adjunct is 110.1, and the sub-classification for Detachable Handle is 422. As this device is not a piece of hand-carried luggage in and of itself, it falls under the sub-classification of Detachable Handle as a handle attachment to a piece of Hand-carried Luggage.

Some prior wheeled travel bags having extendable and retractable handle assemblies and attachments have been proposed and numerous patents have been issued to address the challenge of wheeled luggage handle configuration. The following is a list patents directed to this topic and related topics:

1. U.S. Pat. No. 5,722,118, granted Mar. 3, 1998, "Handle Conversion Apparatus," Hansen et al.;
2. U.S. Pat. No. 6,301,746, granted Oct. 16, 2001, "Telescoping-Handle Assembly For Luggage And Other Luggable Items," Myers et al.;
3. U.S. Pat. No. 6,578,231, granted Jun. 17, 2003, "Luggage Handle," Godshaw et al.

The examples above are typical of many wheeled luggage objects, with an extendable and retractable handle assembly that is longitudinal in nature to the length of the bag and therefore rigid and difficult to manipulate without discomfort to the user. The examples above are attachments that extend the length of the fixed luggage handle assembly, but neither addresses the difficulty and discomfort associated with the proximity of the user to the forward motion of the wheeled object from a lateral perspective.

The luggage marketplace has been saturated with hand-carried, wheeled objects, and new requirements have become apparent in their design. Nearly every wheeled bag has an extendable and retractable handle frame with attached handle. However, given the angle of the bag when the handle is extended and in use (tilted forward approximately 45 degrees to the surface where it is rolling), limitations are evident in terms of proximity of the respective user. Different users have different requirements for navigating a wheeled object, particularly due to their personal body type, posture, and preference. For example, if the user is of a particularly tall or short height, or someone with a particularly long or wide stride, the normal pulling configuration is cumbersome and even restrictive. Restrictions include the user's feet or legs bumping into the piece of luggage and disrupting its roller track, potentially causing the piece to fall over and cause injury. User fatigue in the hand, wrist, arm, and shoulder are also possible, given the strain put on these extremities in order to manipulate the wheeled luggage away from the body. One sign of this type of disadvantaged operation is when the wheeled piece of luggage appears to be swerving back and forth behind the user. This is due to strain on the shoulder and to the user trying to avoid hitting their feet on their aft stride. Consequently, the proposed device serves as a solution to these problems as an attachment to current wheeled bags and similar hand-carried objects.

BRIEF SUMMARY OF THE INVENTION

This invention is directed to correct the problems noted in the Background section and assist the user of hand-carried luggage in maintaining lateral obstruction-free use of a wheeled object. The intent of the attachment device is to create enough lateral clearance between the user's body, legs, and feet and the luggage piece or handle framework to provide this obstruction-free use.

One innovative design of this device is the lateral proximity to the wheeled object fixed handle assembly with which it is used. When attached to the upper extremity of the preexisting handle assembly, just under the fixed handle grip and to the two supporting distal units attached to the handle grip, the device then extends the handle gripping area towards the user's body. Depending on the width of the fixed handle assembly, the extended gripping area is still several inches. While this device extends laterally from the handle assembly, in a plane parallel to the preexisting handle grip and allowing for more gripping area for the user, it typically does not extend beyond the entire width of the wheeled object and therefore does not restrict the normal operation of the object through doorways or security screening apparatus.

Another innovative feature of this device is the range of motion it provides the user in manipulating a wheeled object in normal operations. The extra gripping area, extended laterally from the fixed handle assembly in a plane parallel to the preexisting handle grip but perpendicular to the forward or backward motion of the wheeled object, as prompted by the orientation of the wheels of the object, allows a user to grip the extension and pull or push the wheeled object with a more relaxed angle of the wrist and attitude of the arm. This increased range and relaxed grip allows the user to manipulate the wheeled device further from their body and extremities in motion during a stroll or brisk walk. Feet, thighs, and hips are well distanced from the wheeled object while using the extension, allowing the user to retain a more natural physical stance and posture, operate an even greater pace than normal if necessary, and maintain control and movement of the object.

Additional innovative aspects of this device are the ease of use and adaptability to currently used wheeled objects. The device fits securely to any wheeled object handle assembly and is relatively easy to attach and detach in only a few short steps. The device is a rigid and elongated hand grip apparatus with a first gripping end and an opposite connecting end, whose sole axis between the first and second ends is aligned absolutely parallel to the plane in which a preexisting grip member of a wheeled object handle assembly is oriented. The attachment means of the device comprise an open-ended forked second connecting end having an opening allowing for the restraint and release of a preexisting distal support unit for said preexisting grip handle and said forked end being aligned with and restrained can be operated with said distal support unit and preexisting grip handle in an integrated capacity. The user fits the forked end of the device to the handle assembly distal support member furthest from their body, rests the device along the handle assembly support member closest to their body, and then secures the device to the assembly. Attachment securing means comprise at least one connecting area with an associated strap, said straps being configured to encircle and restrain said grip member and supporting distal unit of said preexisting handle assembly, through strap affixation means, and to then operate in an integrated capacity with said conversion apparatus and preexisting handle grip of said wheeled object from either the left or right side of said wheeled object, for extended lateral clearance from said wheeled object for either a left or right-handed user, respectively. The strength of the attached device allows for a completely secure fit to the fixed handle assembly and allows for normal operations of the wheeled object, even at odd angles maintained during transport. The basic nature of the device allows for use with most any handle assembly at a relatively inexpensive cost to the user. It is made up of only a few inexpensive yet durable materials. Users can continue to use their currently owned wheeled luggage with this device, attaching and removing it as necessary given operational situations presented in travel and transport, such as security checkpoints or storage in overhead or vehicle compartments.

DETAILED DESCRIPTION OF THE INVENTION

In order to emphasize particular embodiments and innovative aspects of the invention, a number of figures of different perspectives are shown. For ease of interpretation, all numbers used to label particular aspects of the invention are used consistently across each figure for that same aspect.

Figure 1:
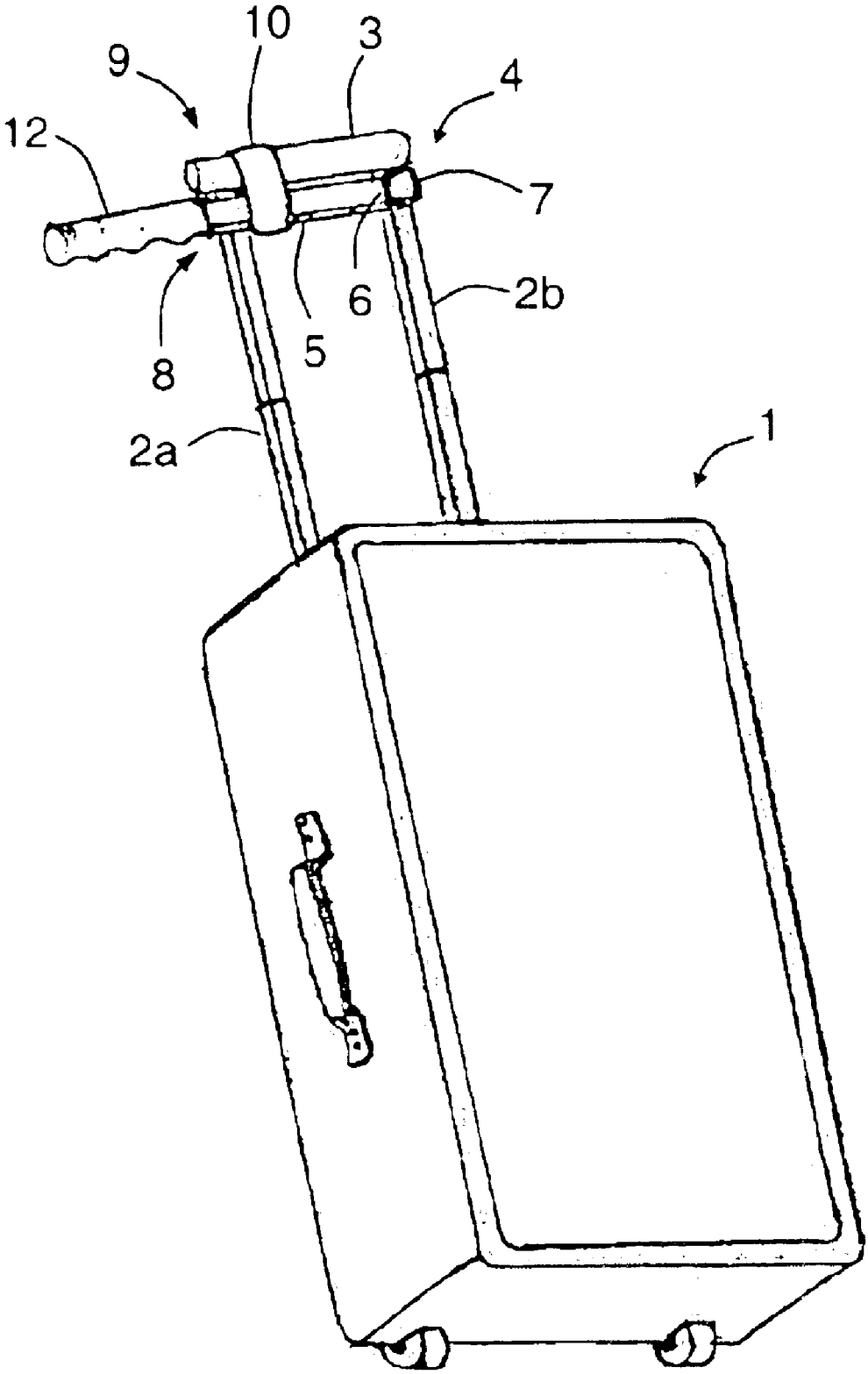
FIG. 1 is an illustration of a wheeled luggage case with a fully extended handle assembly and the Handle Extender attached to the fixed handle assembly.

In FIG. 1, a wheeled luggage case 1 is depicted with the telescopic handle assembly filly extended. The telescopic handle assembly is made up of two telescopic distal support members 2*a*/2*b* that connect to a fixed handle 3, all of which is attached permanently to the wheeled case 1. The telescopic handle assembly can be extended out from or retracted into the wheeled case. Because the supporting members are attached to the handle 3 at the top and to the wheeled case at the bottom, the entire telescopic assembly is quite rigid. Also shown in this figure is the invention attached to the fixed handle assembly and ready for use. The base connecting end 4 of the invention comprises an open-ended forked connecting end having an opening (detailed in FIG. 4 and FIG. 5) allowing for the restraint and release of a preexisting distal support unit 2*b* of a luggage handle. The forked-end opening will fit from the inside of said member on the side furthest from the user 2*b*. On the main body 5 of the invention, the area between the gripping and connecting ends, next to the base connecting end opening 4, there is an attached security connection means 6 (detailed in FIG. 3 and FIG. 5). This connector secures a horizontal strap 7 (detailed in FIG. 3 and FIG. 5) to the invention main body. On the center section of the invention main body 5, is another security connection means 9 (not visible in this view). Once the invention is in place and the horizontal strap 7 is secure, the user then wraps the second strap 10 vertically and tightly around the fixed luggage handle 3 and presses the self-adhesive to itself for ultimate security. Finally, the handle gripping end 12 of the invention is shown to extend laterally from the fixed handle assembly, close to the user.

Figure 2:
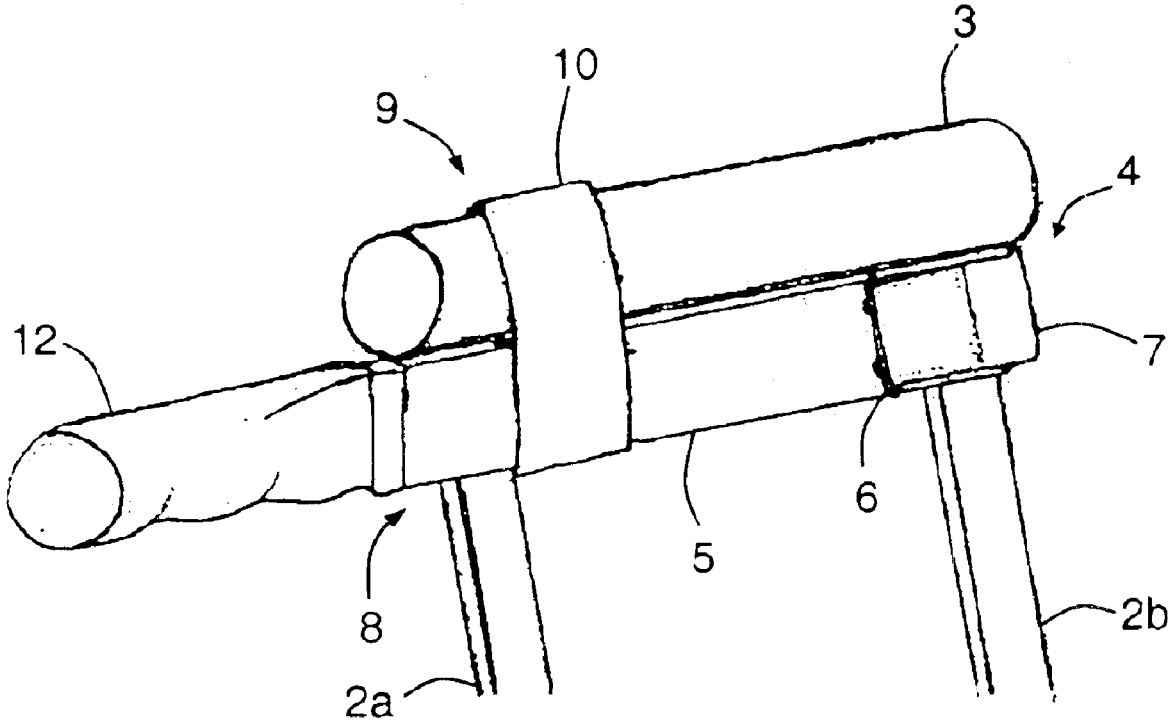
FIG. 2 is another view of the Handle Extender attached to a fixed handle assembly of a wheeled luggage object. The view is the outside view, where the side shown would face up as the wheeled object is being pulled forward.

In FIG. 2, a close-up view of the invention is shown from the same vantage point as in FIG. 1, the outer side of the handle assembly. Again, the illustration depicts the telescopic handle assembly fully extended, however only the top portions of the distal support members 2*a*/2*b* are shown. In this example, the supporting members are fully extended and attached to the fixed handle 3. Also shown in this figure is the invention attached to the fixed handle assembly and ready for use. As in FIG. 1, the base connecting end 4 of the invention comprises an open-ended forked connecting end having an opening (detailed in FIG. 4 and FIG. 5) allowing for the restraint and release of a preexisting distal support unit 2*b* of a luggage handle. The forked-end opening will fit from the inside of said member on the side furthest from the user 2*b*. On the main body 5 of the invention, the area between the in and connecting ends, next to the base connecting end opening 4, there is an attached security connection means 6 (detailed in FIG. 3 and FIG. 5). This connector secures a horizontal strap 7 (detailed in FIG. 3 and FIG. 5) to the main body of the invention. On the center section of the invention main body 5 is another security connection means 9 (not visible in this view). Once the invention is in place and the horizontal strap 7 is secure, the user wraps the second strap 10 vertically and tightly around the fixed luggage handle 3 and presses the self-adhesive to itself for ultimate security. Finally, the handle extension gripping end 12 of the invention is shown to extend laterally from the fixed handle assembly, close to the user.

Figure 3:
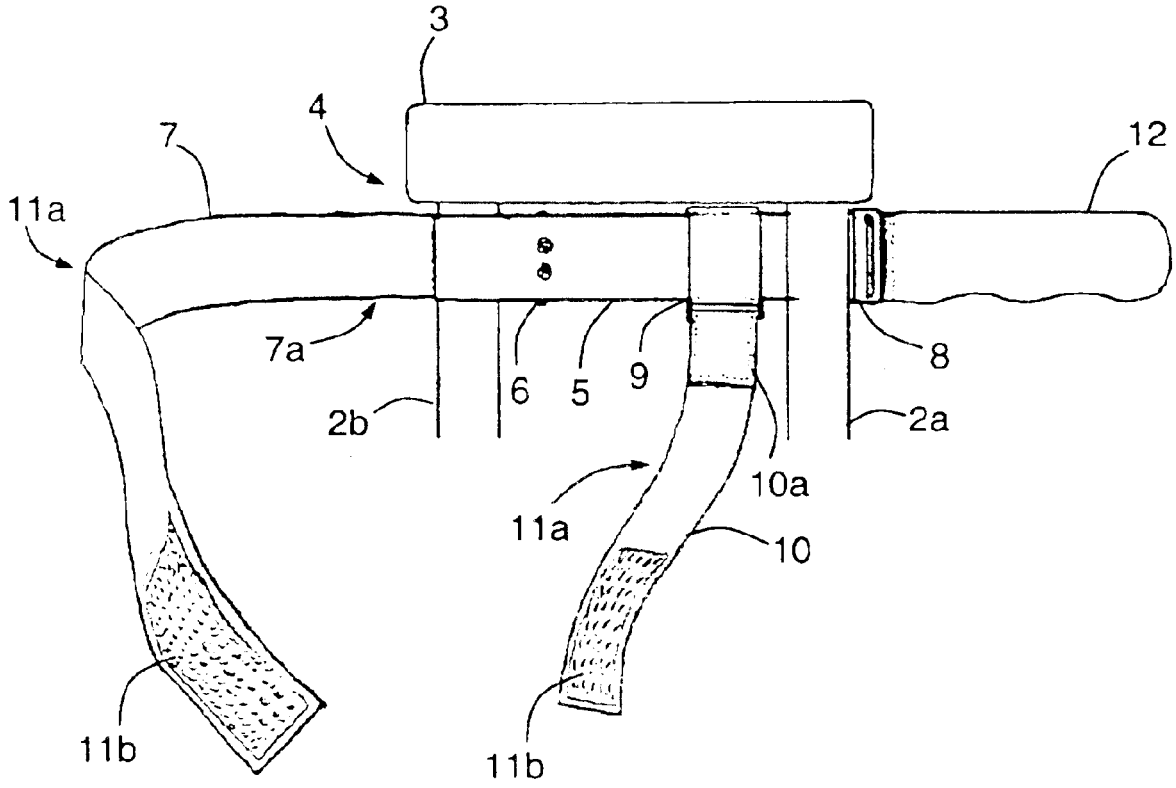
FIG. 3 is a view of the Handle Extender in place on a fixed handle assembly of a wheeled luggage object. The device has not yet been secured to the fixed handle assembly as the straps have not been secured. The view is the inside view, where the side shown would face down to the ground as the wheeled object is being pulled forward.

In FIG.3, an exploded view from the inner side of the handle assembly is shown. It should be noted that the invention support connecting straps are not secured so as to show the configuration of said straps and respective areas for securing said straps. The forked base connecting end 4 of the invention is positioned against one distal base support member 2*b* of a luggage handle. The forked-end opening fits from the inside of said member, just under the fixed handle 3, and on the side furthest from the user 2*b*. Then said strap 7 is configured to encircle and restrain said supporting distal unit of said preexisting handle assembly, through strap affixation means, and to then operate in an integrated capacity with said conversion apparatus and preexisting handle grip of said wheeled object from either the left or right side of said wheeled object. Next to the handle gripping end of the handle extension 12 is a strap connector area 8 for the horizontal strap. The strap is self-adhesive in that one side, of looped self-adhesive 11*a*, will mate with the opposite side, of hooked self-adhesive 11*b* for a secure affixation. This connector area 8 is where the loose end of the first horizontal securing strap is threaded through and then attached back onto itself using the self-adhesives. Due to varying widths of the base support members of wheeled luggage pieces, albeit only a few inches in length, the invention main body 5 and horizontal attachment strap 7 will be long enough to accommodate these varying lengths, while still providing a secure fit to the fixed handle assembly. On the center section of the invention main body 5, another securing strap connector area 9 allows for a vertical strap 10 to be attached permanently to the vertical connector area. Once the invention is in place and the first horizontal strap is secure, the user wraps the second vertical strap 10 tightly around the luggage handle grip and presses the self-adhesive to itself for ultimate security. The strap is self-adhesive in that one side, of looped self-adhesive 11*a*, will mate with the opposite side, of hooked self-adhesive 11*b* for a secure affixation. Finally, the handle grip 12 of the invention is shown to extend laterally from the fixed handle assembly, close to the user.

Figure 4:
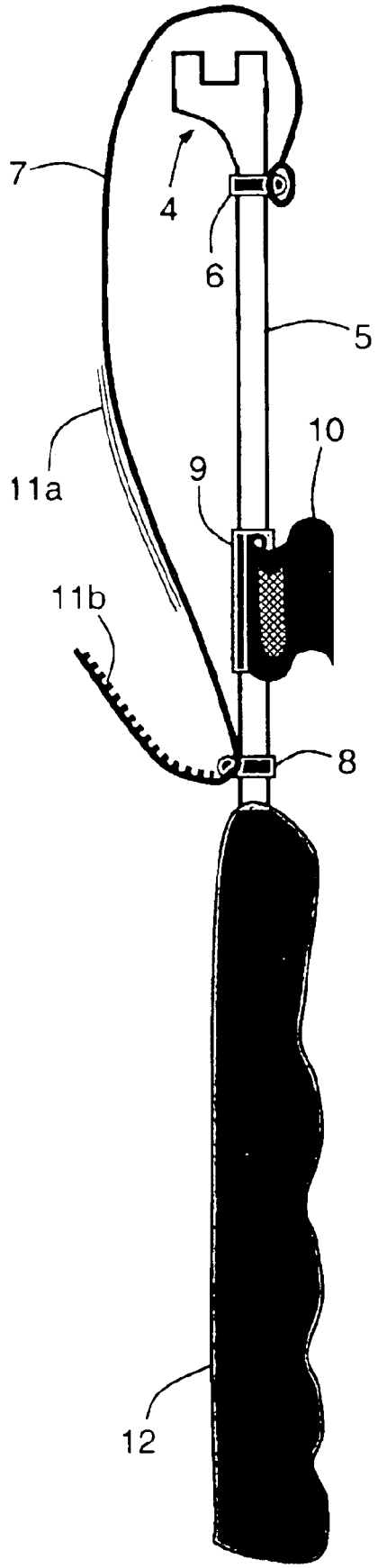
FIG. 4 is a computer-generated illustration of the Handle Extender not yet secured to a luggage object. This top section view highlights the forked connecting end, but without the securing self-adhesive strips.

FIG. 4 is a computer-generated drawing of the top view perspective of the invention. Without repeating the detail in the previous illustrations, the main aspects will be noted but the forked base connecting end 4 will be the focus of this drawing. In this view, the handle extender grip 12 is shown at the bottom of the drawing. Moving up, the horizontal looped connector area 8 is shown where the horizontal strap 7 loops through and attaches itself using self-adhesives 11*a*/11*b*. Continuing up the main body 5 of the invention, the vertical strap connector area 9 is shown with attached vertical strap 10. At the top of this drawing is the forked base connecting end 4 of the invention. As mentioned in previous drawings, next to the forked base connecting end, the horizontal strap connector 6 is attached to the main body. This forked-end opening fits against the handle assembly distal support member furthest from the user and then the horizontal and vertical straps are used to secure the invention to the handle assembly. Of note in this drawing are the self-adhesive strips on the horizontal strap, where the hooked 11*b* adhesive side fits through the horizontal connector and attaches to the soft adhesive 11*a* side.

Figure 5:
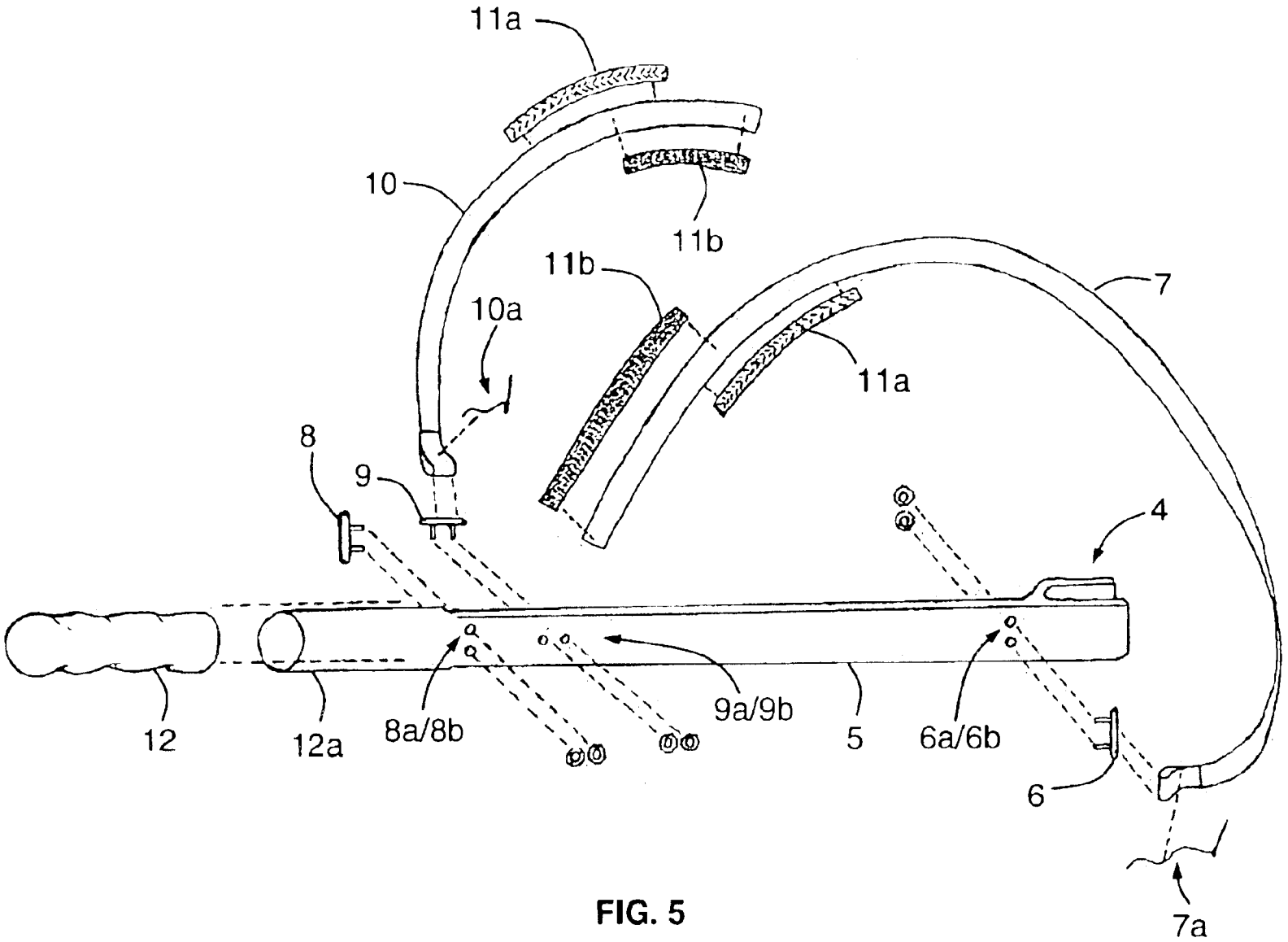
FIG. 5 is an exploded view of the Handle Extender in pre-assembled form.

FIG. 5 is an exploded view of the invention in pre-assembled form. Each of the component parts is emphasized in this view with motion lines to show the assembly configuration. This example emphasizes strap connector areas that utilize connecting attachment assemblies, as opposed to FIG. 4 which emphasized connector areas integrated into the main body for the invention. The main body 5 of the invention is one solid piece of solid and rigid material where all other components are attached. The main body 5 is molded or formed from wood, metal, or most likely hardened plastic. Solid plastic will provide the necessary strength for the handle extender and be less of a security risk with regard to airport security procedures so it is the material of choice. One end of the main body 5 is where the forked base connecting end 4 is molded. On the opposite end of the main body 5 the rectangular and relatively flat structure of the main body is then molded into a rounded, cylindrical gripping end 12*a*. On the main body, just inside of this rounded end 12*a* are two predrilled holes 8*a*/8*b* to house the horizontal strap connector attachment 8. Moving further toward the center of the main body 5 of the invention, two more predrilled holes 9*a*/9*b* house the vertical strap connector attachment 9. To assemble the Handle Extender, the horizontal strap connector attachment 8 is inserted into the predrilled holes 8*a*/8*b* and is secured onto the connector through security means to the main body 5. The vertical strap connector attachment 9 is inserted into its predrilled holes 9*a*/9*b* and then similarly attached tightly to the main body thought security means. The horizontal base strap connector attachment 6 is inserted into its predrilled holes 6*a*/6*b* and fastened tightly to the main body 5 through security means. The horizontal strap 7 is permanently attached 7*a* to the horizontal base strap connector 6. The vertical strap 10 is similarly permanently attached 10*a* to the vertical strap connector 9. The straps are self-adhesive in that one side, of looped self-adhesive 11*a*, will mate with the opposite side, of hooked self-adhesive 11*b* for a secure affixation. Finally, a plastic or rubber molded grip 12 is slid securely onto the rounded end of the main body 5 of the invention. Depending on the security of the fit of the grip 12 to the rounded end, some type of glue or adhesive may be necessary to ensure a permanent fit.

Figure 6:
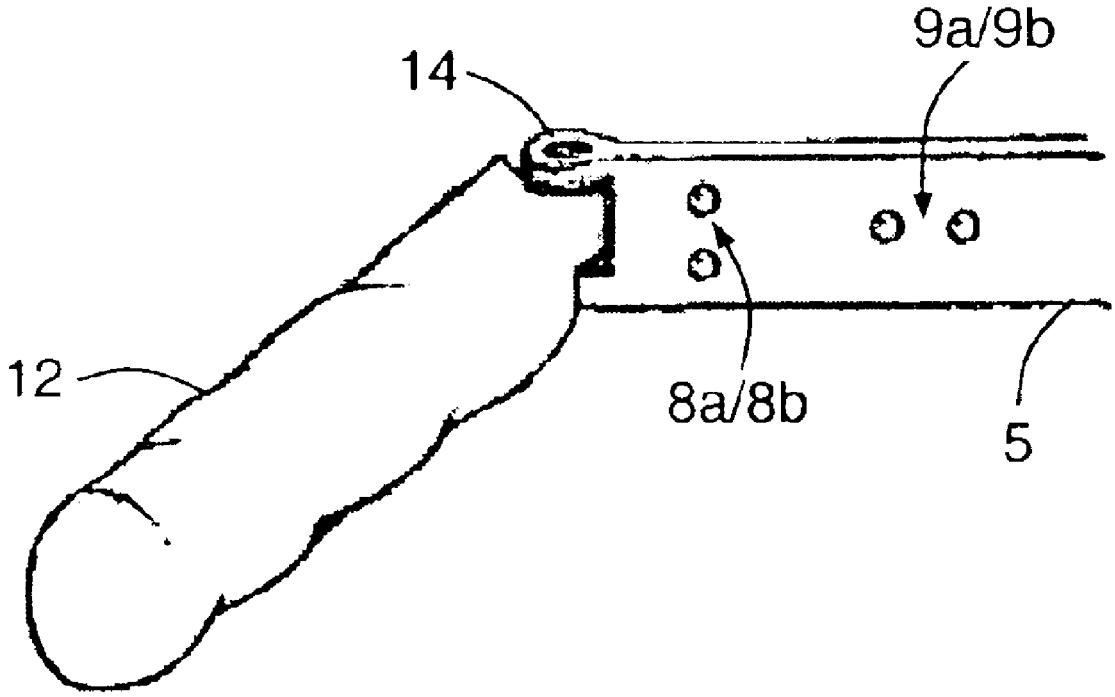
FIG. 6 is an alternative representation of functionality of the invention, with a modification for a collapsible handle gripping area where the actual grip can be folded horizontally to the side of the invention.
Figure 6:
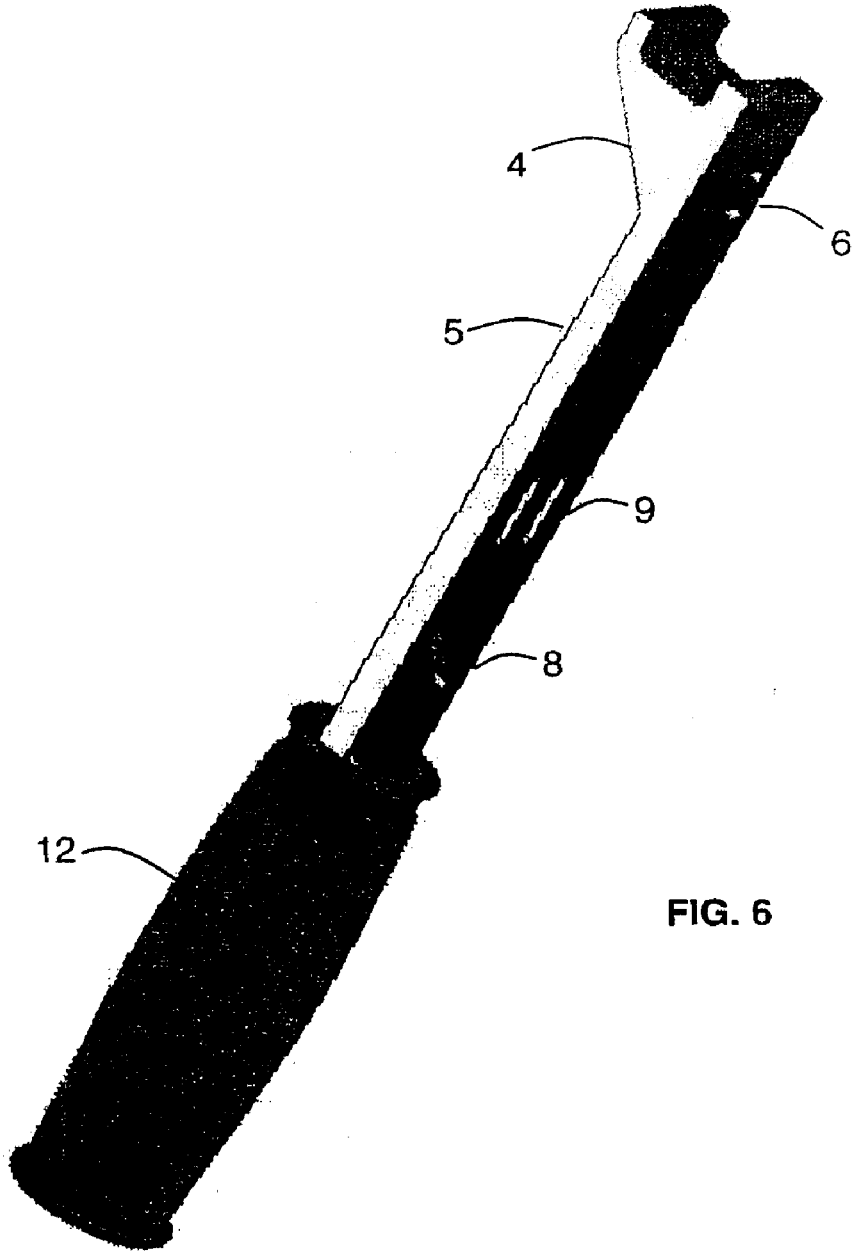

FIG. 6 is an alternative representation of said invention, but without showing the attachment straps. This example emphasizes connector areas integrated into the main body of the invention, as opposed to FIG. 5 which emphasizes connector areas that utilize connection attachment assemblies. Without repeating the detail in the previous illustrations, the main aspects will be noted but the forked base connecting end 4 will be the focus of this drawing. In this view, the handle extender grip 12 is shown at the bottom of the drawing. Moving up, the horizontal strap connector area 8 is shown where the horizontal strap 7 (not shown) loops through and attaches itself using self-adhesives 11*a*/11*b* (not shown). Continuing up the main body 5 of the invention, the vertical strap connection area 9 is where the vertical strap 10 (not shown) would be permanently attached. Next to the forked base connecting end on the main body of the invention, the horizontal strap connector area 6 is shown where the horizontal strap 7 (not shown) would be permanently attached. Finally, at the top of this drawing is the forked base connecting end 4 of the invention where, as mentioned in previous drawings, the forked-end opening fits against the handle assembly distal support member furthest from the user and then the horizontal and vertical straps are used to secure the invention to the handle assembly.

The drawings described highlight many of the unique features of this invention. Particularly, the ease of use is demonstrated in the simple attachment procedure of fitting the invention forked base connecting end onto the handle assembly distal supports, securing the device using self-adhesive straps, and gripping the handle extension on the gripping end. The invention is compact, just more than twice the length of a typical fixed 9 handle, and also durable, with only a few component parts required for assembly. The invention as described provides the added lateral clearance from wheeled objects for users to achieve a greater and freer range of motion when in use. The invention, being attached to said preexisting handle assembly so as to operate in an integrated capacity to each other in parallel orientation to preexisting grip and perpendicular orientation to preexisting distal support members, is such that said apparatus attachment means is oriented in an axis parallel to the plane in which said preexisting handle grip is oriented and substantially within the perpendicular plane described by the said direction of forward and backward motion of said wheeled object.

What is claimed is:

1. A luggage item handle conversion apparatus for facilitating lateral user clearance, said conversion apparatus comprising:

a rigid and elongated hand grip apparatus with a first gripping end and an opposite connecting end, whose sole axis between the first and second ends is aligned absolutely parallel to the plane in which a preexisting grip member of a wheeled object handle assembly is oriented;

the preexisting handle assembly on said wheeled object, consisting of a grip member with a longitudinal axis positioned for use in a plane perpendicular to the direction of forward or backward motion, as prompted by the orientation of the wheels on said wheeled object, and said preexisting grip member being permanently supported by two distal and telescopic support units on the latitudinal axis, positioned in a plane parallel to the direction of forward or backward motion of the wheeled object;

apparatus attachment means for attaching and restraining the said handle conversion apparatus in a parallel axis to said preexisting handle grip, but in a perpendicular axis to said preexisting supporting distal units, to restrain and stabilize the orientation of said preexisting handle assembly members relative to said apparatus attachment means;

said hand grip apparatus being attached to said preexisting handle assembly so as to operate in an integrated capacity to each other in parallel orientation to preexisting grip and perpendicular orientation to preexisting distal support members, such that said apparatus attachment means is oriented in an axis parallel to the plane in which said preexisting handle grip is oriented and substantially within the perpendicular plane described by the said direction of forward and backward motion of said wheeled object.

2. The handle conversion system according to claim 1 wherein said apparatus attachment means comprises an open-ended forked second connecting end having an opening allowing for the restraint and release of a preexisting distal support unit for said preexisting grip handle and said forked end being aligned with and restrained can be operated with said distal support unit and preexisting grip handle in an integrated capacity.

3. The handle conversion apparatus according to claim 1 wherein said apparatus attachment means comprises at least one connecting area with an associated strap, said straps being configured to encircle and restrain said grip member and supporting distal unit of said preexisting handle assembly, through strap affixation means, and to then operate in an integrated capacity with said conversion apparatus and preexisting handle grip of said wheeled object from either the left or right side of said wheeled object, for extended lateral clearance from said wheeled object for either a left or right-handed user, respectively.

4. The handle conversion apparatus according to claim 3 wherein the strap affixation means comprises at least one pair of self-adhesive material.

5. The handle conversion system according to claim 1 in which the invention further comprises a gripping surface fitted on the gripping end of the apparatus for a plurality of hand indentations, maximizing user gripping retention.

6. A luggage item handle conversion apparatus for facilitating lateral user clearance, said conversion apparatus comprising, in combination:

a rigid and elongated hand grip apparatus with a first gripping end and an opposite connecting end, whose sole axis between the first and second ends is aligned absolutely parallel to the plane in which a preexisting grip member of a wheeled object handle assembly is oriented; and the preexisting handle assembly on said wheeled object, consisting of a grip member with a longitudinal axis positioned for use in a plane perpendicular to the direction of forward or backward motion, as prompted by the orientation of the wheels on said wheeled object, and said preexisting grip member being permanently supported by two distal and telescopic support units on the latitudinal axis, positioned in a plane parallel to the direction of forward or backward motion of the wheeled object; and apparatus attachment means for attaching and restraining the said handle conversion apparatus in a parallel axis to said preexisting handle grip, but in a perpendicular axis to said preexisting supporting distal units, to restrain and stabilize the orientation of said preexisting handle assembly members relative to said apparatus attachment means; and said hand grip apparatus being attached to said preexisting handle assembly so as to operate in an integrated capacity to each other in parallel orientation to preexisting grip and perpendicular orientation to preexisting distal support members, such that said apparatus attachment means is oriented in an axis parallel to the plane in which said preexisting handle grip is oriented and substantially within the perpendicular plane described by the said direction of forward and backward motion of said wheeled object.

7. The handle conversion system according to claim 6 wherein said apparatus attachment means comprises an open-ended forked second connecting end having an opening allowing for the restraint and release of a preexisting distal support unit for said preexisting grip handle and said forked end being aligned with and restrained can be operated with said distal support unit and preexisting grip handle in an integrated capacity.

8. The handle conversion apparatus according to claim 6 wherein said apparatus attachment means comprises at least one connecting area with an associated strap, said straps being configured to encircle and restrain said grip member and supporting distal unit of said preexisting handle assembly, through strap affixation means, and to then operate in an integrated capacity with said conversion apparatus and preexisting handle grip of said wheeled object from either the left or right side of said wheeled object, for extended lateral clearance from said wheeled object for either a left or right-handed user, respectively.

9. The handle conversion apparatus according to claim 8 wherein the strap affixation means comprises at least one pair of self-adhesive material.

10. The handle conversion system according to claim 6 in which the invention further comprises a gripping surface fitted on the gripping end of the apparatus for a plurality of hand indentations, maximizing user gripping retention.

* * * * *

UNITED STATES PATENT AND TRADEMARK OFFICE

CERTIFICATE OF CORRECTION

PATENT NO. : 6,920,667 B2
DATED : July 26, 2005
INVENTOR(S) : Charles David Joesten It is certified that error appears in the above-identified patent and that said Letters Patent is hereby corrected as shown below:

Delete Drawing Sheet 6, and replace with Drawing Sheet 6 attached.

Column 3,
Lines 45-47, "This top section view highlights the forked connecting end, but without the securing self-adhesive strips." should be -- This top section view highlights the forked connecting end, but without the self-adhesive straps secured. --.
Lines 50-53, "FIG. 6 is an alternative representation of functionality of the invention, with a modification for a collapsible handle gripping area where the actual grip can be folded horizontally to the side of the invention." should be -- FIG. 6 is an alternative representation of the Handle Extender, but without showing the attachment straps, that emphasizes integrated strap connector areas. --.

Signed and Sealed this

Tenth Day of January, 2006

JON W. DUDAS
*Director of the United States Patent and Trademark Office*